US007501986B2

(12) United States Patent
Byström et al.

(10) Patent No.: US 7,501,986 B2
(45) Date of Patent: Mar. 10, 2009

(54) ANTENNA ARRANGEMENT FOR A PORTABLE RADIO COMMUNICATION DEVICE, AND A PORTABLE RADIO COMMUNICATION DEVICE COMPRISING SUCH AN ANTENNA ARRANGEMENT

(75) Inventors: Greger Byström, Umeå (SE); Kjell Carlsson, Upplands Väsby (SE)

(73) Assignee: AMC Centurion AB, Akersberga (SE)

( * ) Notice: Subject to any disclaimer, the term of this patent is extended or adjusted under 35 U.S.C. 154(b) by 162 days.

(21) Appl. No.: 11/572,310

(22) PCT Filed: Jul. 26, 2005

(86) PCT No.: PCT/SE2005/001183

§ 371 (c)(1),
(2), (4) Date: Apr. 23, 2007

(87) PCT Pub. No.: WO2006/016843

PCT Pub. Date: Feb. 16, 2006

(65) Prior Publication Data

US 2008/0094291 A1 Apr. 24, 2008

(30) Foreign Application Priority Data

Aug. 9, 2004 (SE) ..... 0401993

(51) Int. Cl.
*H01Q 1/24* (2006.01)
*H01Q 1/50* (2006.01)

(52) U.S. Cl. ..... 343/702; 343/906; 343/873

(58) Field of Classification Search ..... 343/702, 343/906

See application file for complete search history.

(56) References Cited

U.S. PATENT DOCUMENTS

| | | | | |
|---|---|---|---|---|
| 6,577,280 | B2 * | 6/2003 | Kim | 343/702 |
| 6,597,919 | B1 * | 7/2003 | Kumar et al. | 455/510 |
| 2004/0051673 | A1 | 3/2004 | Moren et al. | |
| 2004/0130494 | A1 * | 7/2004 | Fukushima et al. | 343/702 |
| 2006/0038729 | A1 * | 2/2006 | Ohno et al. | 343/713 |

FOREIGN PATENT DOCUMENTS

| | | |
|---|---|---|
| EP | 1 351 332 A1 | 10/2003 |
| WO | WO 00/74171 | 12/2000 |

OTHER PUBLICATIONS

International Searching Authority "International Preliminary Report on Patentability and Written Opinion of the International Searching Authority" Sep. 28, 2005.

* cited by examiner

*Primary Examiner*—Trinh V Dinh
(74) *Attorney, Agent, or Firm*—Holland & Hart LLP

(57) ABSTRACT

The present invention relates to an antenna arrangement for a portable radio communication device, such as a mobile phone, including RF circuitry and a portable radio communication device comprising such an antenna arrangement. The antenna arrangement is characterized in that a first connection portion (17; 25) of an antenna element (10) extends in a first direction in a plane defined by the substantially planar antenna element (10) and a second connection portion (18; 26) of the antenna element (10) extends in a second direction opposite said first direction, such that the sum of said extensions is constant.

18 Claims, 4 Drawing Sheets

ANTENNA ARRANGEMENT FOR A PORTABLE RADIO COMMUNICATION DEVICE, AND A PORTABLE RADIO COMMUNICATION DEVICE COMPRISING SUCH AN ANTENNA ARRANGEMENT

FIELD OF THE INVENTION

The present invention generally relates to antenna arrangements. Particularly, the present invention relates to an antenna arrangement for a portable radio communication device.

BACKGROUND OF THE INVENTION

As portable radio communication devices, such as mobile phones, become smaller the electronic components contained within the devices, e.g. the antennas, will also need to be smaller. The electrical connections between these components are realized by means of connectors, which should provide good and well-defined electrical contact between the components and which should be insensitive to small variations in manufacturing dimensions and in the mounting process.

Therefore, an elastic type or a spring type of connector is becoming increasingly attractive for small components. Such connectors are known to provide reliable electrical connection between components. Spring features of a connector provide a well-defined contact and the flexibility to avoid tolerances build up when manufacturing dimensions are not all perfectly exact. The compliance is also needed to accommodate departures from planarity as is common in high volume manufacturing processes where contact pads may not be exactly planar.

The conventional method of electrically connecting an electronic component, being of a miniature size, is to interpose, between the electronic component and a printed circuit board, an electrical connector such as a spring-loaded contact, such as a pogo pin.

In U.S. patent application Ser. No. 2004/0051673 an antenna arrangement is disclosed utilizing e.g. pogo pins to connect an antenna element to a PCB. Such an antenna arrangement of the above-mentioned US patent application is illustrated in FIGS. 1 and 2. The antenna arrangement comprises an antenna element 1 supported by a support structure 2. The support structure 2 comprises a first and a second aperture 5 and 6, into which a first and a second connection portion 7 and 8 are positioned. A first and a second connection device 3 and 4, such as pogo pins, are arranged in the apertures 5 and 6 to fixate the connection portions 7 and 8 to the support structure 2.

A problem with the antenna arrangement disclosed in the above-mentioned US patent application is illustrated in FIGS. 3-5. FIG. 3 illustrate the two apertures 5 and 6, for simplicity positioned adjacent each other. When the antenna element 1 is mounted in a correct position on the support structure 2 the connection portions 7 and 8 have a desired length extending in the plane of the antenna element 1, as illustrated in FIG. 3. When the antenna element 1 is mounted in a position displaced from the correct position the length of the connection portions 7 and 8 extending in the plane of the antenna element 1 either is increased or decreased as illustrated in FIGS. 4 and 5 respectively. Such mounting deviations result in that the resonance frequency/frequencies for the antenna arrangement is/are spread from the desired resonance frequency/frequencies, which is not desirable.

SUMMARY OF THE INVENTION

An object of the present invention is to provide an antenna arrangement that eliminate the above-mentioned problem.

This object, among others, is according to the present invention attained by an antenna arrangement and a portable radio communication device, respectively, as defined in the appended claims.

By a first connection portion of an antenna element extending in a first direction and a second connection portion of the antenna element extending in a second direction opposite the first direction the sum of the extensions is constant irrespectively of mounting displacement of the antenna element on a support structure. Thus, the effect on the resonance frequency of the antenna arrangement caused by mounting displacement of the flexible antenna element on a support structure is eliminated.

Further features and advantages of the present invention will be evident from the following description.

BRIEF DESCRIPTION OF THE DRAWINGS

The present invention will become more fully understood from the detailed description of embodiments given below and the accompanying drawings, which are given by way of illustration only, and thus, are not limitative to the present invention, wherein.

DETAILED DESCRIPTION OF EMBODIMENTS

In the following description, for purpose of explanation and not limitation, specific details are set forth, such as particular techniques and applications in order to provide a thorough understanding of the present invention. However, it will be apparent for a person skilled in the art that the present invention may be practiced in other embodiments that depart from these specific details. In other instances, detailed description of well-known methods and apparatuses are omitted so as not to obscure the description of the present invention with unnecessary details.

Figure 6:
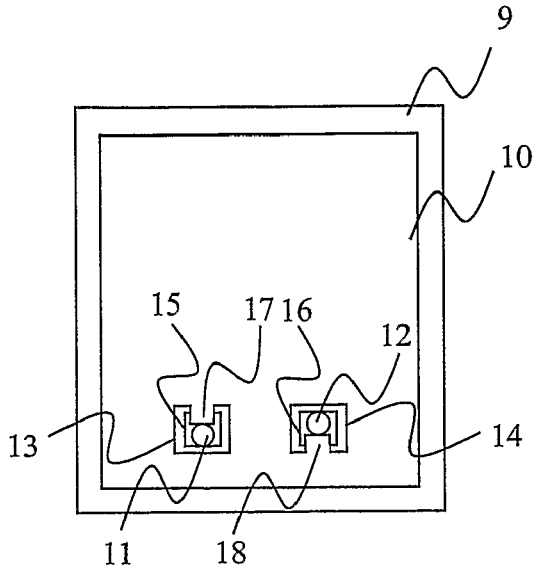
FIG. 6 illustrates an antenna arrangement according to a first embodiment of the present invention.
Figure 7:
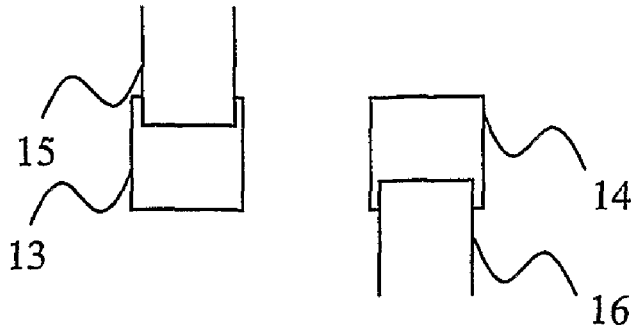
FIG. 7 illustrates a correctly mounted antenna element in a first embodiment of the present invention.
Figure 8:
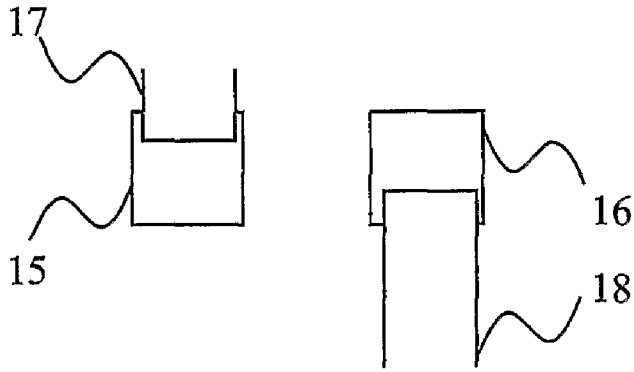
FIG. 8 illustrates an incorrectly mounted antenna element in the first embodiment the present invention.

A first embodiment of the present invention will now be described with reference to FIGS. 6-8.

An antenna arrangement for a portable radio communication device, such as e.g. a mobile phone, a PDA or a portable computer, comprises a substantially planar flexible antenna element 10, such as a flex film antenna element, and a support structure 9 for support of the antenna element 10. The flexible antenna element 10 includes two connection portions 17 and 18; one for feeding the antenna and the other for grounding the antenna. The connection portions 17, 18 are preferably provided by punching out two parts 13 and 14 of the flexible antenna element 10, resulting in tow connection portions 17, 18 distanced from the rest of the antenna element 10.

The support structure 9 includes two apertures 15 and 16 for receiving the two connection portions 17 and 18, respectively. The antenna arrangement further comprises two connection devices 11 and 12, each of which preferably has a longitudinal axis, such as pogo pins or contact sheets, for connecting the antenna element 10 to RF circuitry (i.e. feeding and grounding) of the portable radio communication device. The expression longitudinal axis is used to define the direction through the apertures. The two apertures 15 and 16 are further for receiving the two connection devices 11 and 12.

Only one set of a connection device 11, a corresponding aperture 15 and a corresponding connection portion 17 will next be described, as the two sets are identical in form. The connection device 11 is arranged to fixate one connection portion 17 in the aperture 15 by means of radial forces. An upper end of the connection device 11 fixates a lower end of the connection portion 17 in the aperture 15 and thereby electrically connects to the antenna element 10. This upper end of the connection device 11 is of uniform thickness along a length that preferably correspond to the length the connection portion 17 that extends down into the aperture 15. The other end of the connection device 11 is preferably axially resilient, for connection to a printed wiring board of the portable radio communication device, for connection to the RF circuitry of the portable radio communication device. Due to the axial resilience of the connection device 11 the radial forces necessary to prevent axial displacement of the connection device is greatly reduced, when the antenna arrangement is mounted to a printed wiring board of the portable radio communication device.

The aperture 15 has a square shaped cross-section, such that at least the side receiving the connection portion 17 is planar. Further, the connection device 11 preferably has a circularly shaped cross-section, such that at least the part contacting the connection portion 17 has a rounded surface. In this way a well-defined contact is achieved between the connection portion 17 and the connection device 11.

The antenna arrangement is by the above-described configuration easily adapted to requirements on the space an antenna arrangement may occupy in a housing of e.g. a mobile telephone and contact positions on a printed wiring board for connection to RF circuitry in the mobile telephone. The support structure 9 is easily adapted to fit a specific volume. The apertures 15, 16 are easily provided in different positions in the support structure 9 in connection with desired contact positions on the printed wiring board. The flexible antenna element 10 is mounted to the support structure 9. The connection portions 17, 18 are positioned in the apertures 15, 16. The connection devices 11, 12 are positioned in the respective apertures 15, 16, fixating the corresponding connection portions 17, 18 in the respective apertures 15, 16 and electrically connect them thereto. A stopper may also be provided in the apertures 15, 16 to prevent the connection devices 11, 12 from being pushed to deep into the apertures 15, 16, which facilitate mounting of a connection devices 11, 12.

In an alternative mounting process, the connection portion 17 may be positioned above the aperture 15 instead of in the aperture 15, to be positioned in the aperture 15 by means of the positioning of the connection device 11 into the aperture 15.

The antenna arrangement is then ready to be positioned in the housing of e.g. a mobile telephone. It is not necessary to know the exact distance between the support structure 9 and the contact positions on the printed wiring board of the portable radio communication device when the connection devices 11, 12 are axially resilient. The axial resilience further lowers the radial forces needed to maintain the connection devices 11, 12 in their respective apertures 15, 16.

The connection portions 17 and 18 extend in opposite directions in a plane defined by the substantially planar flexible antenna element 10. When the substantially planar flexible antenna element 10 is mounted to the support structure 9 to a desired position the extensions of the connection portions 17, 18 extend an equal amount from the apertures 15, 16, which is illustrated in FIG. 7. However, if the mounting of the substantially planar flexible antenna element 10 onto the support structure 9 is displaced from the desired position the connection portions 17, 18 will extend to a different degree from the apertures 15, 16, which is illustrated in FIG. 8. The electrical length of the sum of the extensions of the connection portions 17, 18 in the plane defined by the substantially planar flexible antenna element 10 will still be the same as when the substantially planar flexible antenna element 10 is mounted in the desired position. This will thus result in reduced frequency spreading for the antenna arrangement due to mounting displacement of the substantially planar flexible antenna element 10 to the support structure 9.

Figure 1:
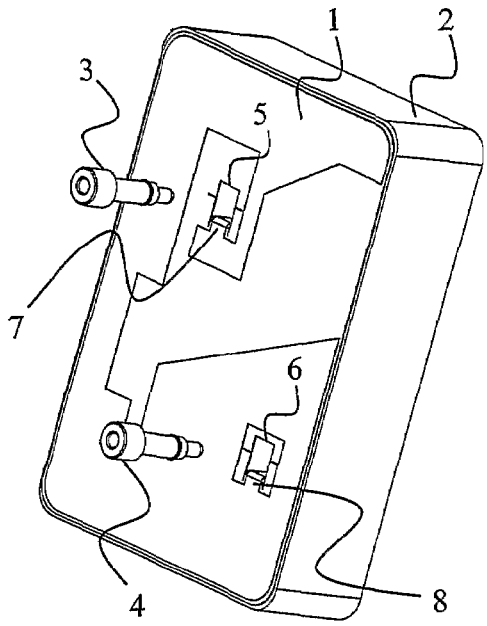
PRIOR ART FIG. 1
FIG. 1 illustrates an antenna arrangement according to prior art.
Figure 2:
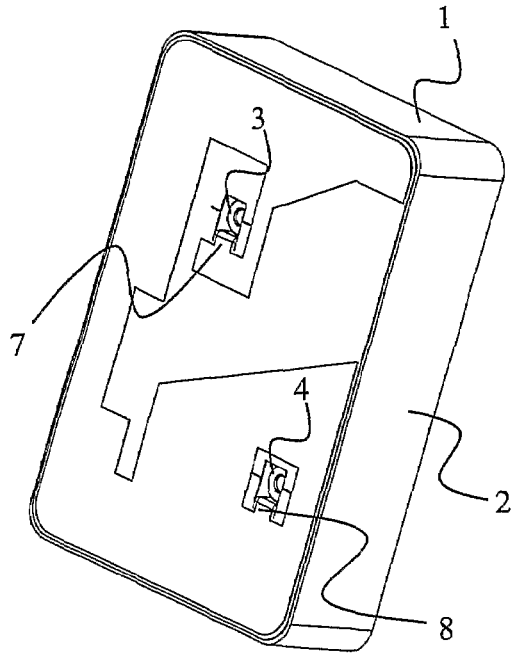
PRIOR ART FIG. 2
FIG. 2 shows contact devices in a mounted position of the antenna arrangement illustrated in FIG. 1.
Figure 3:
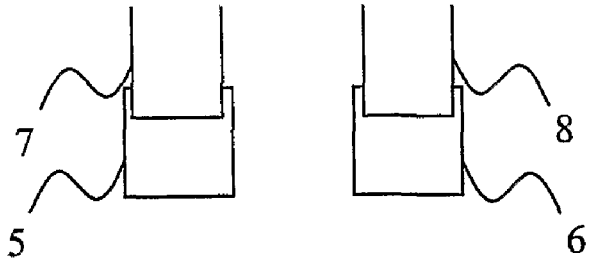
PRIOR ART FIG. 3
FIG. 3 illustrates a correctly mounted antenna element according to prior art.
Figure 4:
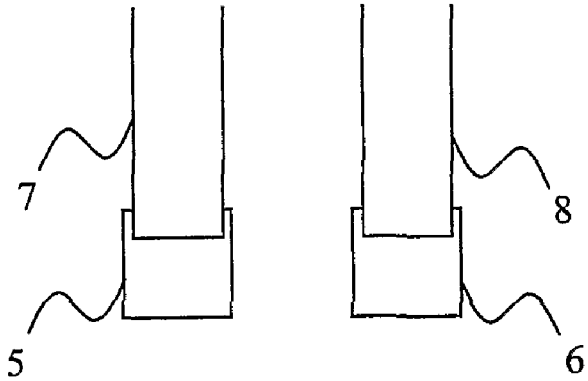
PRIOR ART FIG. 4
FIG. 4 illustrates an incorrectly mounted antenna element according to prior art.
Figure 5:
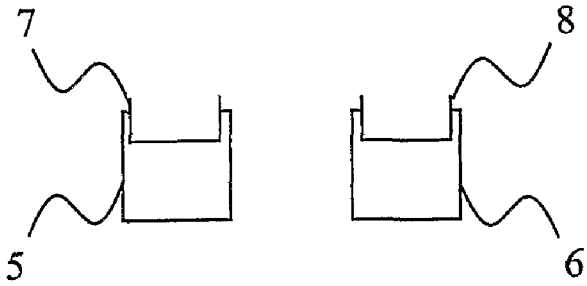
PRIOR ART FIG. 5
FIG. 5 illustrates an incorrectly mounted antenna element according to prior art.
Figure 10:
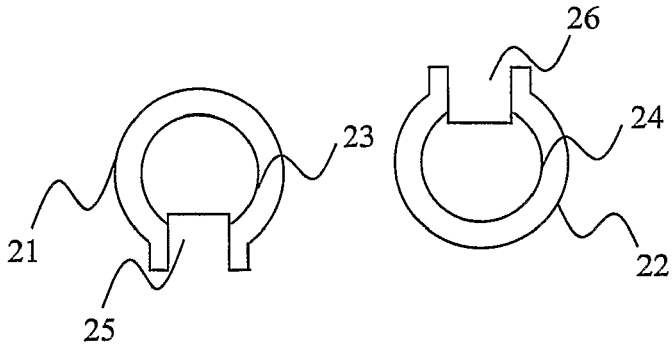
FIG. 10 illustrates a correctly mounted antenna element in the second embodiment of the present invention.
Figure 11:
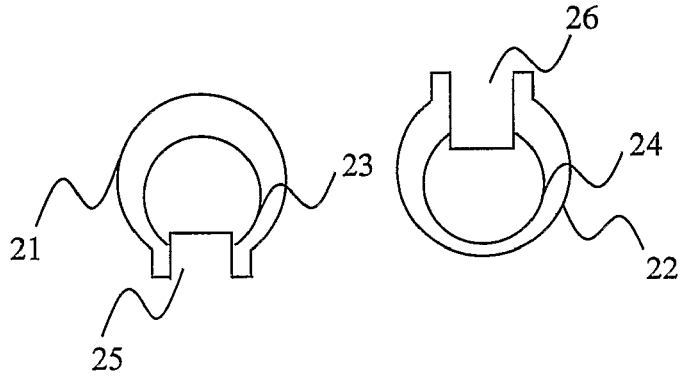
FIG. 11 illustrates an incorrectly mounted antenna element in the second embodiment the present invention.
Figure 9:
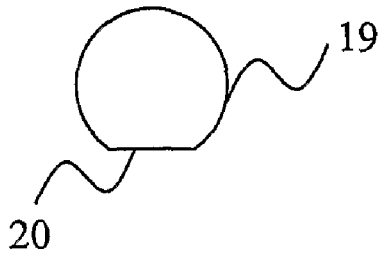
FIG. 9 illustrates a cross-section of an aperture according to a second embodiment of the present invention.

A second embodiment of the present invention will now be described with reference to FIGS. 9-11. This second embodiment of the present invention is identical to the first embodiment described above, apart from the following.

Each of the apertures 23 and 24 has a substantially circular cross-section 19. The cross-section of the apertures 23, 24 further comprises a planar part 20 for receiving the connection portions 25 and 26. Thus, a rounded surface of the connection devices press against the connection portions 25 and 26, which are supported by a planar surface. Also, a rounded surface of the connection devices press against a correspondingly rounded surface of the circular part 19 of the apertures 23, 24. Preferably, the punch-outs 21, 22 of the substantially planar flexible antenna element antenna element are also substantially circular, which provides for further reduction in frequency deviations.

The above used term flex film, should be interpreted as a flexible and thin material comprising conductive portions such as wires or bands.

It will be obvious that the present invention may be varied in a plurality of ways. Such variations are not to be regarded as departure from the scope of the present invention as defined by the appended claims. All such variations as would be obvious for a person skilled in the art are intended to be included within the scope of the present invention as defined by the appended claims.

The antenna element 10 has been described as being substantially planar. It will be appreciated that the antenna element can take other shapes, such as a convex shape, without departing from the inventive idea.

The invention claimed is:

1. An antenna arrangement for a portable radio communication device including RF circuitry, said antenna arrangement comprising:

a flexible antenna element (10) comprising a first and a second connection portion (17, 18; 25, 26);

a support structure (9) supporting said flexible antenna element (10) and comprising a first and a second aperture (15, 16; 23, 24); and a first and a second connection device (11, 12) for connecting said flexible antenna element antenna element (10) to the RF circuitry of the portable radio communication device, wherein said first connection device (11) is positioned in said first aperture (15; 23) and said second connection device (12) is positioned in said second aperture (16; 24), wherein said first and second connection devices (11, 12) fixate said first and second connection portions (17, 18; 25, 26) to said support structure (9) and electrically connect said first and second connection portions (17, 18; 25, 26) to said first and second connection devices (11, 12) by means of radial forces; and characterized in that said first connection portion (17; 25) extends in a first direction in a plane defined by said flexible antenna element (10) and said second connection portion (18; 26) extends in a second direction opposite said first direction, such that the sum of said extensions is constant irrespectively of mounting displacement of the antenna element on said support structure.

2. The antenna arrangement as claimed in claim 1, wherein each of said first and second connection devices (11, 12) has a longitudinal axis and is axially resilient for connection to said RF circuitry.

3. The antenna arrangement as claimed in claim 1, wherein said connection portions (17, 18; 25, 26) are elongated.

4. The antenna arrangement as claimed in claim 3, wherein said connection portions (17, 18; 25, 26) are rectangular-shaped.

5. The antenna arrangement as claimed in claim 1, wherein said antenna element (10) comprises a first and a second punch out (13, 14; 21, 22) forming said connection portions (17, 18; 25, 26).

6. The antenna arrangement as claimed in claim 5, wherein an outer form of said punch-outs (21, 22) is substantially circular.

7. The antenna arrangement as claimed in claim 1, wherein said apertures (23, 24) have a substantially circular cross-section for supporting said connection devices.

8. The antenna arrangement as claimed in claim 7, wherein said apertures (23, 24) comprise a planar surface for supporting said connection portions (25, 26).

9. The antenna element as claimed in claim 1, wherein said antenna element (10) is substantially planar.

10. An apparatus, comprising:

a portable radio communication device comprising RF circuitry and an antenna arrangement;

the antenna arrangement, comprising:

a flexible antenna element (10) comprising a first and a second connection portion (17, 18; 25, 26);

a support structure (9) supporting said flexible antenna element (10) and comprising a first and a second aperture (15, 16; 23, 24); and a first and a second connection device (11, 12) for connecting said flexible antenna element antenna element (10) to the RF circuitry of the portable radio communication device, wherein said first connection device (11) is positioned in said first aperture (15; 23) and said second connection device (12) is positioned in said second aperture (16; 24), wherein said first and second connection devices (11, 12) fixate said first and second connection portions (17, 18; 25, 26) to said support structure (9) and electrically connect said first and second connection portions (17, 18; 25, 26) to said first and second connection devices (11, 12) by means of radial forces; and characterized in that said first connection portion (17; 25) extends in a first direction in a plane defined by said flexible antenna element (10) and said second connection portion (18; 26) extends in a second direction opposite said first direction, such that the sum of said extensions is constant irrespectively of mounting displacement of the antenna element on said support structure.

11. The apparatus as claimed in claim 10, wherein each of said first and second connection devices (11, 12) has a longitudinal axis and is axially resilient for connection to said RF circuitry.

12. The apparatus as claimed in claim 10, wherein said connection portions (17, 18; 25, 26) are elongated.

13. The apparatus as claimed in claim 12, wherein said connection portions (17, 18; 25, 26) are rectangular-shaped.

14. The apparatus as claimed in claim 10, wherein said antenna element (10) comprises a first and a second punch out (13, 14; 21, 22) forming said connection portions (17, 18; 25, 26).

15. The apparatus as claimed in claim 14, wherein an outer form of said punch-outs (21, 22) is substantially circular.

16. The apparatus as claimed in claim 10, wherein said apertures (23, 24) have a substantially circular cross-section for supporting said connection devices.

17. The apparatus as claimed in claim 16, wherein said apertures (23, 24) comprise a planar surface for supporting said connection portions (25, 26).

18. The apparatus as claimed in claim 10, wherein said antenna element (10) is substantially planar.

* * * * *